United States Patent [19]

Schräwer et al.

[11] 4,187,956

[45] Feb. 12, 1980

[54] SAFETY INSERT FOR STORAGE VESSELS OF LOW-BOILING LIQUIFIED GASES

[75] Inventors: Rolf Schräwer, Bruchköbel; Werner K. Diehl; Hans M. Ringelstein, both of Frankfurt am Main, all of Fed. Rep. of Germany

[73] Assignee: Messer Griesheim GmbH, Frankfurt am Main, Fed. Rep. of Germany

[21] Appl. No.: 949,153

[22] Filed: Oct. 6, 1978

[30] Foreign Application Priority Data

Oct. 22, 1977 [DE] Fed. Rep. of Germany ..... 2747492

[51] Int. Cl.[2] ..... B65D 25/00; F17C 13/04

[52] U.S. Cl. ..... 220/465; 62/45; 62/54; 141/285; 220/85 V; 220/901

[58] Field of Search ..... 62/45, 54; 141/1, 98, 141/82, 285, 309, 392, 301, 302; 220/303, 367, 465, 901, 855, 85 V

[56] References Cited

U.S. PATENT DOCUMENTS

| | | | |
|---|---|---|---|
| 1,712,977 | 5/1929 | Bohnhardt | 141/285 X |
| 2,594,244 | 4/1952 | Winternitz | 220/465 X |
| 3,705,498 | 12/1972 | DeHaan | 62/54 |
| 4,122,969 | 10/1978 | Hugley | 220/367 X |

*Primary Examiner*—Frederick R. Schmidt
*Attorney, Agent, or Firm*—Connolly and Hutz

[57] ABSTRACT

A safety insert for storage vessels of low-boiling liquified gases includes a safety neck tube placed within the neck forming an annular space with respect thereto, the neck having a blind flange with a fill and extraction hole for the gas as well as a safety valve and vent pipe with a stopcock mounted onto the neck and with a gas outlet hole in the safety neck tube.

3 Claims, 1 Drawing Figure

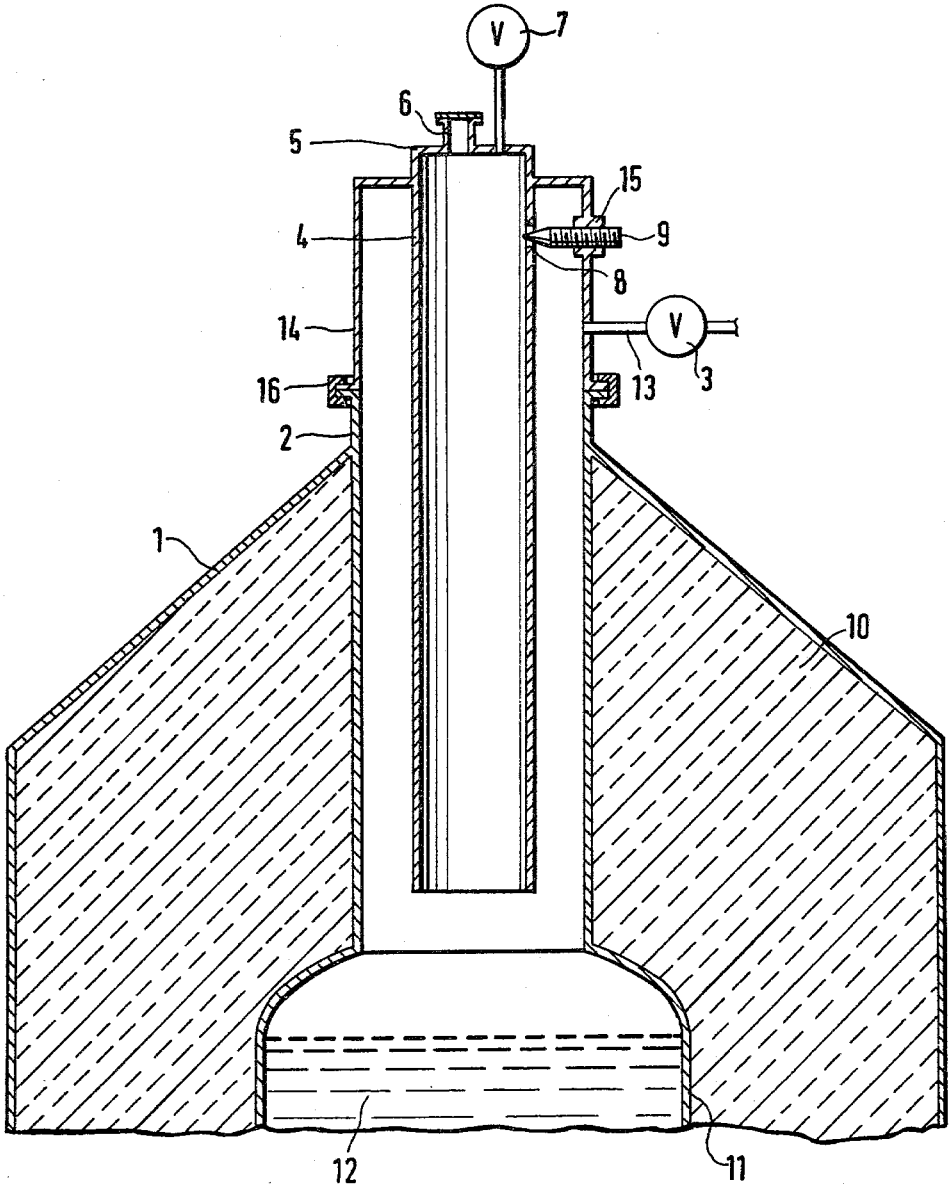
V
7
6
5
15
4
9
8
14
V
3
16
13
2
1
10
12
11

SAFETY INSERT FOR STORAGE VESSELS OF LOW-BOILING LIQUIFIED GASES

BACKGROUND OF INVENTION

The invention concerns a safety insert for storage vessels of low-boiling, liquified gases.

In storage vessels for low-boiling gases which have a necklike opening for filling and extraction, helium tanks for, example, there is a danger, as a result of air penetration, that water vapor, carbon dioxide or air will freeze out in the vessel neck and clog the neck. Since the low-boiling, liquified gas vaporizes further in the vessel, great pressure builds up in the vessel which finally destroys the vessel through an explosion.

Safety inserts are used to preclude this danger. Such a safety insert consists of a safety neck tube placed in the neck of the vessel, which forms an annular space with the vessel neck. The safety neck tube is sealed from the exterior and has take-up devices for a siphon for the filling and extraction of the liquified gas, as well as connections for a safety valve and optional additional apparatuses. The vent pipe for extracting the liquified gas is mounted onto the vessel neck. This vent pipe represents a junction of the annular space in the vessel neck with the exterior. During normal operation, the vaporized gas flows outward through this pipe. When excess pressure builds up in the neck, for example, as a result of non-extraction of vaporized gas over a longer period of time, vaporized gas flows away through the safety neck tube and the safety valve. During normal operation, therefore, there is a gas column in the safety neck tube and a flowing gas quantity in the annular space. The latter is very desirable for an intense, so-called neck gas cooling. For this reason, the annular space is made narrow to maintain as great a flow velocity as possible.

The gas column in the safety neck tube is disadvantageous, however. Namely, a noticeable heat transfer to the liquid by gas-heat conduction results through the stationary gas column.

SUMMARY OF INVENTION

The object of the invention is therefore to make a safety insert for storage vessels of low-boiling, liquified gases, consisting of a safety neck tube which is placed in the vessel neck with the formation of an annular space, with blind flange, fill and extraction hole for liquified gas, and safety valve, as well as a vent pipe with stopcock mounted on the vessel neck, in which no stationary gas column can form in the safety neck tube, and in which consequently the heat transfer to the liquified gas and thereby the evaporation losses are reduced.

According to the invention this is achieved by a gas outlet hole in the safety neck tube.

For an optimum reduction of the evaporation rate, it is essential that the gas outlet hole have an adjustable cross-section in order to be able to set the flow ratios in each vessel individually. For this purpose, the gas outlet hole is designed to be a bore, the cross-section of which is adjustable by means of a tapered pin. The seat of the tapered pin is preferably in the vessel neck so that it can be adjusted from the exterior.

In the safety insert according to the invention, the major quantity of the vaporized gas flows outward through the annular space and the vent pipe mounted onto the vessel neck. However, a small amount flows through the safety neck tube situated in the vessel neck and through the gas outlet made in it according to the invention, first into the annular space and from there through the vent pipe mounted onto the vessel neck to the outside. It is hereby achieved that there is no stationary gas column either in the annular space or in the safety neck which would increase the gas heat conduction into the liquid and increase the evaporation losses.

It is hereby further advantageous that no Taconis vibrations develop. These are mechanical thermal vibrations of a gas column which cause severe evaporation.

The same effect could be obtained by replacing the safety valve with a regulating valve. Then it would sometimes be necessary to set the safety valve and the stopcock in such a way that an optimum separation of exhaust gas results. But aside from the fact that, hereby, the safety effect connected with the safety valve would be lost, it would also be necessary to reset the valves after each filling and extraction. An exact reproducability would in addition only be achieved with the help of expensive metering valves. On the other hand the gas outlet hole, located according to the invention, suitably reduced the evaporation rate without influencing the safety valve in any way. However, since even vessels with the same construction produce a different separation of exhaust gas, the optimum is obtained if the cross-section of the gas outlet hole is adjustable. Then the optimum separation of exhaust gas can be set for each vessel individually. When the optimum ratio of the exhaust gas currents is set, by means of a tapered pin, for example, the tapered pin is locked. The function of all other apparatuses of the safety insert remains undisturbed.

The Drawing

The drawing illustrates an embodiment of the invention in longitudinal section.

DETAILED DESCRIPTION

The upper part of a helim tank is depicted in the drawing. By means of an insulation 10, the outer container 1 surrounds the inner container 11 which holds the liquid helium 12. The inner container 11 is connected with the outer container 1 through the vessel neck 2.

The safety insert consists of the head 14 with vent pipe 13 and stopcock 3, as well as the safety neck tube 4, which is sealed off from the outside by a blind flange 5. A fill and extraction hole 6 for liquified gas and a safety valve 7 are situated on the blind flange 5. The safety insert is fastened onto the vessel neck 2 with a flanged joint 16.

According to the invention, a gas outlet hole 8 is provided in the safety neck tube 4. For an optimum separation of exhaust gas it is essential that the cross-section of the gas outlet hole 8 be adjustable. A tapered pin 9, which is screwed into a seat 15 located in the head 14, serves this purpose. The tapered pin 9 can be screwed in more or less far into the gas outlet hole 8 from the exterior. The tapered pin 9 is locked as soon as the optimum distribution of the exhaust currents is obtained. This optimum is obtained when the evaporation rates are lowest. The optimum position for the tapered pin 9 has to be calculated with measurements for each vessel. In actual practice the evaporation rates were reduced by one-half with the safety insert according to the invention.

What is claimed is:

1. In a safety insert for storage vessels for low boiling, liquified gases wherein the vessel has a neck, a safety tube disposed longitudinally within said neck in flow communication with the contents of the vessel, an annular space being formed between said neck and said safety tube, a flange closing off the outer end of said neck and said safety tube, a fill and extraction opening in said flange for the liquified gas, a safety valve in said flange, a vent pipe having a stop cock in said neck communicating with said annular space and the atmosphere, a gas outlet hole in said safety tube, said gas outlet hole having its flow cross-section adjustably by manipulating means external of said vessel, and said gas outlet hole communicating with said annular space and by way of said pipe also communicating with the atmosphere whereby a portion of vaporized gas flows through said annular space and exits from said vent pipe and a remaining portion of vaporized gas flows through said safety tube and exits from said outlet hole so as to prevent any stationary column from being in either said annular space or said safety tube and thus reducing heat transfer to the liquified gas and minimizing evaporation losses.

2. Safety insert according to claim 1, characterized in that said fill and extraction opening is disposed in line with and in communication with said safety tube.

3. Safety insert according to claim 1, characterized thereby that said manipulating means comprises a tapered pin penetrating into said hole.

* * * * *